US012116030B2

(12) United States Patent
Mian et al.

(10) Patent No.: US 12,116,030 B2
(45) Date of Patent: Oct. 15, 2024

(54) METHODS AND SYSTEMS FOR MONITORING A TRANSPORTATION PATH WITH ACOUSTIC OR VIBRATION SENSING

(71) Applicant: Zahid F. Mian, Troy, NY (US)

(72) Inventors: Zahid F. Mian, Loudonville, NY (US); Frederick A. Prahl, Wilmington, MA (US)

(73) Assignee: International Electronic Machines Corp., Troy, NY (US)

( * ) Notice: Subject to any disclaimer, the term of this patent is extended or adjusted under 35 U.S.C. 154(b) by 879 days.

(21) Appl. No.: 17/173,795

(22) Filed: Feb. 11, 2021

(65) Prior Publication Data

US 2021/0253149 A1 Aug. 19, 2021

Related U.S. Application Data

(60) Provisional application No. 63/024,073, filed on May 13, 2020, provisional application No. 63/004,065, (Continued)

(51) Int. Cl.
*B61L 23/04* (2006.01)
*B61L 27/50* (2022.01)
(Continued)

(52) U.S. Cl.
CPC ..... *B61L 23/041* (2013.01); *B61L 23/04* (2013.01); *B61L 23/042* (2013.01); *B61L 23/044* (2013.01); *B61L 23/045* (2013.01); *B61L 23/047* (2013.01); *B61L 23/048* (2013.01); *B61L 27/50* (2022.01); *B61L 27/53* (2022.01); *B61L 27/57* (2022.01); *B61K 9/00* (2013.01); *B61K 9/08* (2013.01); *E01B 35/12* (2013.01)

(58) Field of Classification Search
CPC ..... B61L 23/041; B61L 23/042; B61L 23/04; B61L 23/044; B61L 23/045; B61L 23/047; B61L 23/048; B61L 27/53; B61L 27/57; B61L 27/50; B61K 9/00; B61K 9/08; E01B 35/12
USPC ..... 264/4
See application file for complete search history.

(56) References Cited

U.S. PATENT DOCUMENTS 6,216,985 B1 * 4/2001 Stephens ..... B61K 9/10 246/473 R
8,478,480 B2 * 7/2013 Mian ..... G01M 17/007 348/148

(Continued)

FOREIGN PATENT DOCUMENTS

CN 106794853 A * 5/2017 ..... B61L 15/0027
DE 102014100653 A1 * 7/2015 ..... B61K 9/08

(Continued)

*Primary Examiner* — Zachary L Kuhfuss
*Assistant Examiner* — James William Jones
(74) *Attorney, Agent, or Firm* — LaBatt, LLC

(57) ABSTRACT

Methods and systems for monitoring and detecting various events or anomalies of interest on or along an object of interest, such as a transportation path, road, or railway, are presented. Data regarding the detected events can be collected near its source and transmitted to a data collection or processing object for analysis or storage. These events may include, but not limited to, rock falls, wheel or tire flat spots, or other acoustic or vibration generating events at or near the object of interest.

20 Claims, 8 Drawing Sheets

Related U.S. Application Data filed on Apr. 2, 2020, provisional application No. 62/976,479, filed on Feb. 14, 2020.

(51) Int. Cl.

| | |
|---|---|
| ***B61L 27/53*** | (2022.01) |
| ***B61L 27/57*** | (2022.01) |
| *B61K 9/00* | (2006.01) |
| *B61K 9/08* | (2006.01) |
| *E01B 35/12* | (2006.01) |

(56) References Cited

U.S. PATENT DOCUMENTS

| | | | | |
|---|---|---|---|---|
| 2005/0205718 | A1* | 9/2005 | Tsai | B61L 23/041 246/1 R |
| 2006/0076461 | A1* | 4/2006 | DeRose | B61K 9/00 246/122 R |
| 2009/0326746 | A1* | 12/2009 | Mian | B61L 1/168 701/19 |
| 2016/0207552 | A1* | 7/2016 | Mian | B61L 15/0072 |
| 2016/0368510 | A1* | 12/2016 | Simon | B61L 25/025 |
| 2017/0106887 | A1* | 4/2017 | Mian | B61L 3/02 |
| 2018/0097288 | A1* | 4/2018 | DiDomenico | G06V 20/17 |
| 2018/0170414 | A1* | 6/2018 | Arndt | B64C 39/024 |
| 2018/0208222 | A1* | 7/2018 | Zhang | B60L 1/00 |

FOREIGN PATENT DOCUMENTS

| | | | | |
|---|---|---|---|---|
| WO | WO-2011027166 | A1 * | 3/2011 | B61L 1/06 |
| WO | WO-2012152575 | A1 * | 11/2012 | B61L 1/166 |
| WO | WO-2015178868 | A1 * | 11/2015 | B61K 9/10 |
| WO | WO-2017093715 | A1 * | 6/2017 | B61L 23/041 |
| WO | WO-2017093741 | A1 * | 6/2017 | B61L 23/041 |
| WO | WO-2017167529 | A1 * | 10/2017 | B61L 23/041 |
| WO | WO-2018002582 | A1 * | 1/2018 | B61L 1/06 |

* cited by examiner

METHODS AND SYSTEMS FOR MONITORING A TRANSPORTATION PATH WITH ACOUSTIC OR VIBRATION SENSING

CROSS-REFERENCE TO RELATED APPLICATIONS

The current application claims the benefit of U.S. Provisional Application No. 62/976,479, filed on 14 Feb. 2020; U.S. Provisional Application No. 63/004,065, filed on 2 Apr. 2020; and U.S. Provisional Application No. 63/024,073, filed on 13 May 2020, the disclosures of each of which are hereby incorporated by reference herein in their entirety.

BACKGROUND OF THE INVENTION

Technical Field

The disclosure relates generally to event or anomaly detection, and more particularly, to detecting anomalies related to transportation operations using acoustic sensing.

Description of Related Art

Current systems for monitoring and detecting events, anomalies, or vehicle flaws along a path or thoroughfare, such as, a railroad track, by using distributed acoustic sensing methods are described in U.S. Pat. Nos. 10,281,300 and 10,850,754, among others. However, these prior art methods do not sufficiently address the needs for the monitoring of transportation lines due to the need to either determine the speed of a vehicle to make certain determinations, or these prior art methods lack the use of the vehicle signatures for providing additional event monitoring and detections, such as, in U.S. Pat. No. 10,281,300.

In U.S. Pat. No. 10,850,754, the inventor describes methods and apparatus for monitoring of rail networks using fiber optic distributed acoustic sensing (DAS), especially for condition monitoring. However, the requirement of the methods disclosed the '754 patent to measure the speed of the train prior to applying a correction window is a significant shortcoming of this prior art, as determining speed would require additional hardware thereby making the invention disclosed in the '754 patent virtually useless in train applications.

In order to overcome the significant limitations of this and other prior art, aspects of the present invention may not require a speed-based correction of the data, since, among other things, more sophisticated data analysis algorithms are used to extract vehicle flaw data.

SUMMARY OF THE INVENTION

Aspects of the invention provide a solution for monitoring and detecting various events of interest on or along an object or interest, such as a transportation path, including roads or railways. These events of interest may include anomalies in vehicle operation, hardware damage, obstructions on the path or tracks, and/or pedestrian trespassing, among other, undesirable events. Data regarding the event can be collected near the source of the event and transmitted to a data collection or processing object, for example, a computer or PLC, for analysis or storage. These events or anomalies may include, but not limited to, rock falls, wheel flat spots, and/or other acoustic generating events.

A first embodiment of the invention is a system having interrogating and receiving units spaced along an optical fiber cable deployed alongside an object of interest, such as a transportation path or railroad track, a road, or an assembly line. In one aspect, the receiving units allow the acoustic emission to modify the light propagation attributes of the optical fiber and these modifications are transmitted to an object to analyze, process, and determine identifiable characteristics for the events.

The receiving units incorporate advanced processing algorithms and heuristics that allow the system of the invention to accurately detect and identify key events along the length of the fiber. These algorithms may also eliminate potential false positives—for example, discriminating between flat spots and wheel flanging. Other embodiments are also described.

Another embodiment of the invention is a system for monitoring a transportation path such as a road, railroad track, and others, the system comprising or including: at least one fiber optic fiber extending along at least a portion of a targeted path, the fiber optic fiber having a plurality of imperfections; an interrogator operatively connected to the at least one fiber optic fiber, the interrogator configured to detect variations in reflections from the plurality of imperfections in the at least one fiber optic fiber due to the effect of signals generated by an anomaly along the path; a processor operatively connected to the interrogator, the processor having software adapted to: receive signals from the interrogator corresponding to the detected variations; associate the received signals with one or more anomalies; and depending upon the anomaly, execute one of a plurality of protocols. In one aspect, the signals generated by the anomaly may be acoustic signals or vibration signals. In one aspect, at least one fiber optic fiber may be positioned on a first side of the path, road, or railroad track, and at least one fiber optic fiber positioned on a second side of the path, road, or railroad track, opposite the first side of the path, road, or railroad track.

In one aspect, the detected variations may correspond to wheel anomalies, for example, wheel flats, or out-of-round wheels. In another aspect, the detected variations may correspond to an obstruction on the path, road, or tracks, for example, a rock or a log or tree limb. In one aspect, the detected variations may correspond to foot steps, for example, of a human trespasser or animal intrusion.

In one aspect, the system may include an inspection vehicle, for inspection of the detected anomaly, for example, an unmanned inspection vehicle, such as, an unnamed aerial drone.

Another embodiment of the invention is a method for monitoring a transportation path, the method comprising or including: with at least one fiber optic fiber extending along at least a portion of a targeted transportation path, the fiber optic fiber having a plurality of imperfections, varying the reflections from the plurality of imperfections due to the effect of signals generated by an anomaly along the transportation path; detecting the variations in the reflections: generating electrical signals corresponding to the detected variations; analyzing the generated electrical signals to extract at least one feature of the generated signals; comparing at least one feature to a plurality of features and recognizing at least one feature as one of a plurality of anomalies; and based upon the one of the plurality of anomalies recognized, executing at least one protocol.

In one aspect, the method may further include filtering the generated electrical signals. In another aspect, analyzing the generated electrical signals to extract at least one feature may be implemented by time domain signal analysis, for example, peak-to-peak signal analysis, thresholding signal analysis, FFT signal analysis, and wavelet signal analysis, among others. In another aspect, comparing and recognizing may be practiced by template recognition, rule based behavior recognition, or deep learning based feature signature recognition, among other methods.

In one aspect, the plurality of anomalies may be an anomaly in vehicle operation, derailment, hardware damage, an obstruction on the transportation path, pedestrian trespassing, or animal intrusion, among others.

In one aspect, at least one protocol may be initiating an alert, storing data associated with the detected variations, activating a camera in a vicinity of the anomaly; dispatching an inspection vehicle, or taking no action, among other protocols.

In another aspect, the method may further include detecting a speed of a vehicle traveling along the transportation path with a plurality of sensors, for example, with a plurality of wheel sensors. In another aspect, the method may further include detecting at least one datum for a train traveling along the transportation path with at least one sensor, for example, a vehicle ID, or a vehicle wheel size. The detected wheel size may be used when analyzing the generated electrical signals to extract at least one feature of the generated signals.

These and other aspects of the invention provide methods and systems for generating and monitoring events near an object of interest, such as, a transportation path, road, or railroad track, and others, for the purpose of making an action that provides an advantage, which include and/or implement some or all of the actions described herein. The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a solution for monitoring and detecting various events of interest, such as, operating anomalies or track flaws, on or along an object of interest, such as a transportation path, road, or railway. For descriptive purposes the example of a railway will be used, although the invention applies to transportation paths in general.

Data regarding one or multiple types of effects being generated by events and vehicle operations can be acquired and analyzed. In an illustrative application, the effect-generating events or operations include acoustic, vibration, and other continuous or pulse emissions. The effect data can be monitored and analyzed to determine aspects of the rail vehicles operational health, the health of the rail, and associated events occurring at or near the vehicle, rail, or its surroundings.

Figure 1:
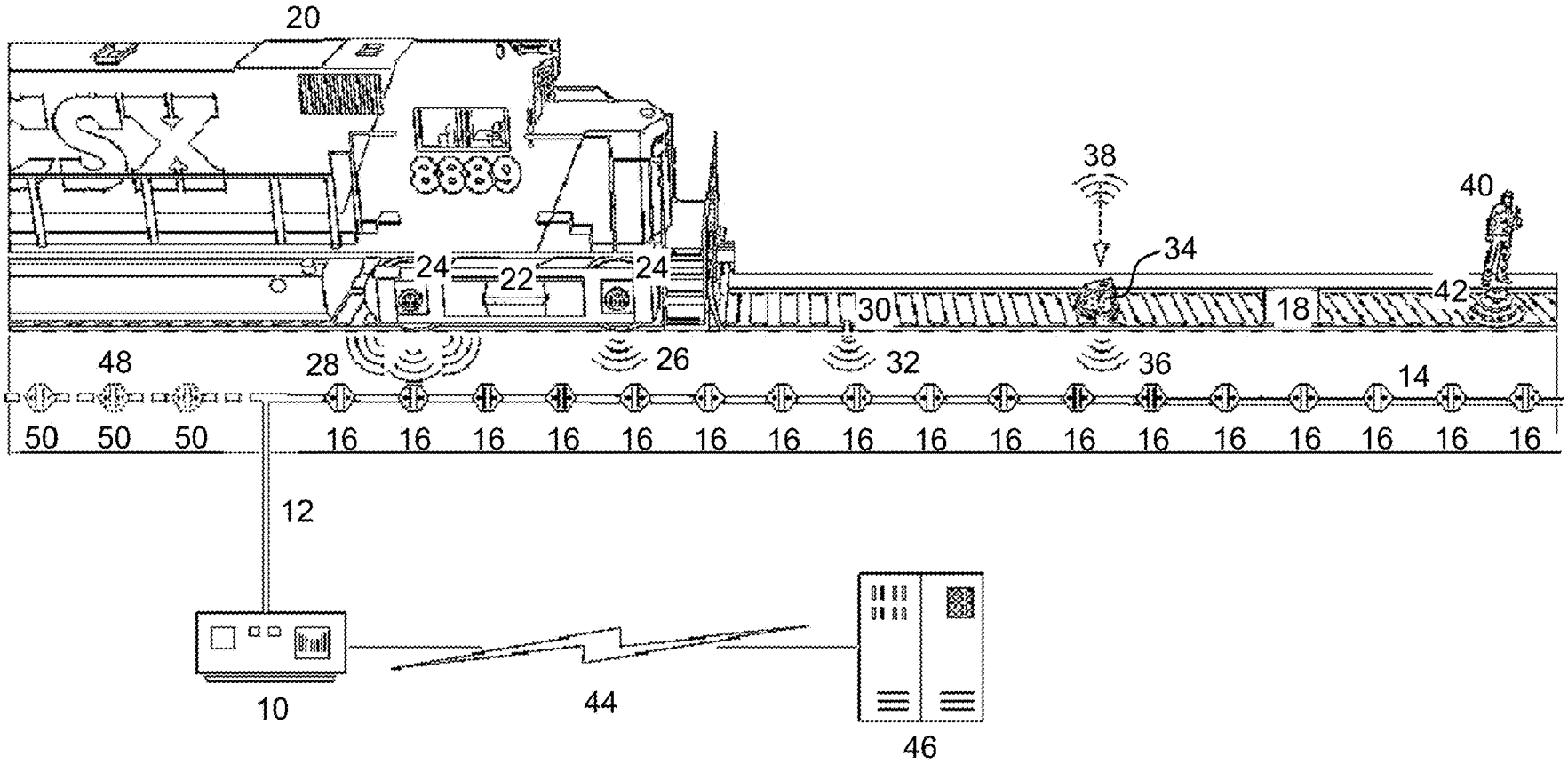
FIG. 1 is a perspective view illustrating an application of one aspect of the invention along a train track.

In FIG. 1, an interrogation unit or interrogator 10 has a connection 12 to a fiber optic fiber 14. This fiber 14 may be one of many in a fiber optic cable already in place for telecommunications purposes, or may be a custom-installed fiber for this specific use. More than one fiber 14 may be used.

As known in the art, the fiber 14 typically includes various imperfections inherent in the manufacturing process that produce Rayleigh scattering when light passes through the fiber 14. This Rayleigh scattering reflects light back down the fiber 14 and the arrival of this reflected light can be measured accurately in time, allowing the sites of scattering to serve as vibration or acoustic sensors 16.

The cable 14 with its sensors 16 may typically be laid substantially parallel to and within reasonable distance of a set of railroad tracks 18, or other path of interest. A train 20 may travel along the tracks 18 on trucks or bogies 22, and in so doing the wheels 24 of trucks 22, being in contact with the rail of the tracks 18, produce vibrations 26. A flawed wheel, such as one with a slid flat, may typically produce different vibration attributes 28, for example, compared to the vibration attributes of a non-flawed wheel.

A crack or break 30 in the track 18 may also produce specific vibration attributes 32 as a train approaches and passes over the break 30. A large item, such as a rock 34, may fall or roll onto the track 18, also producing vibrations 36 which can be detected by at least one of the sensors 16. In addition, if the rock 34 remains on the track 18, the rock 34 may also produce a permanent strain on one or more portions of track 18 from its mass 38, which may also be detected by the local sensors 16.

A human being 40, or other animal of significant size, may also produce characteristic vibrations 42 when, for example, moving, allowing the intrusion by the human or animal to be monitored and evaluated.

According to aspects of the invention, the data collected by the interrogator 10 from the sensors 16 is transmitted through a wired or wireless connection 44 to a central data storage and/or processing facility 46.

Note also that the fiber 14 may be continuous, as indicated at 48, thereby providing continuous coverage of the track 18 for the length of the optical fiber 14.

The processing of the data may take place onboard the interrogator 10 or at the central data storage and/or processing facility 46.

Figure 2:
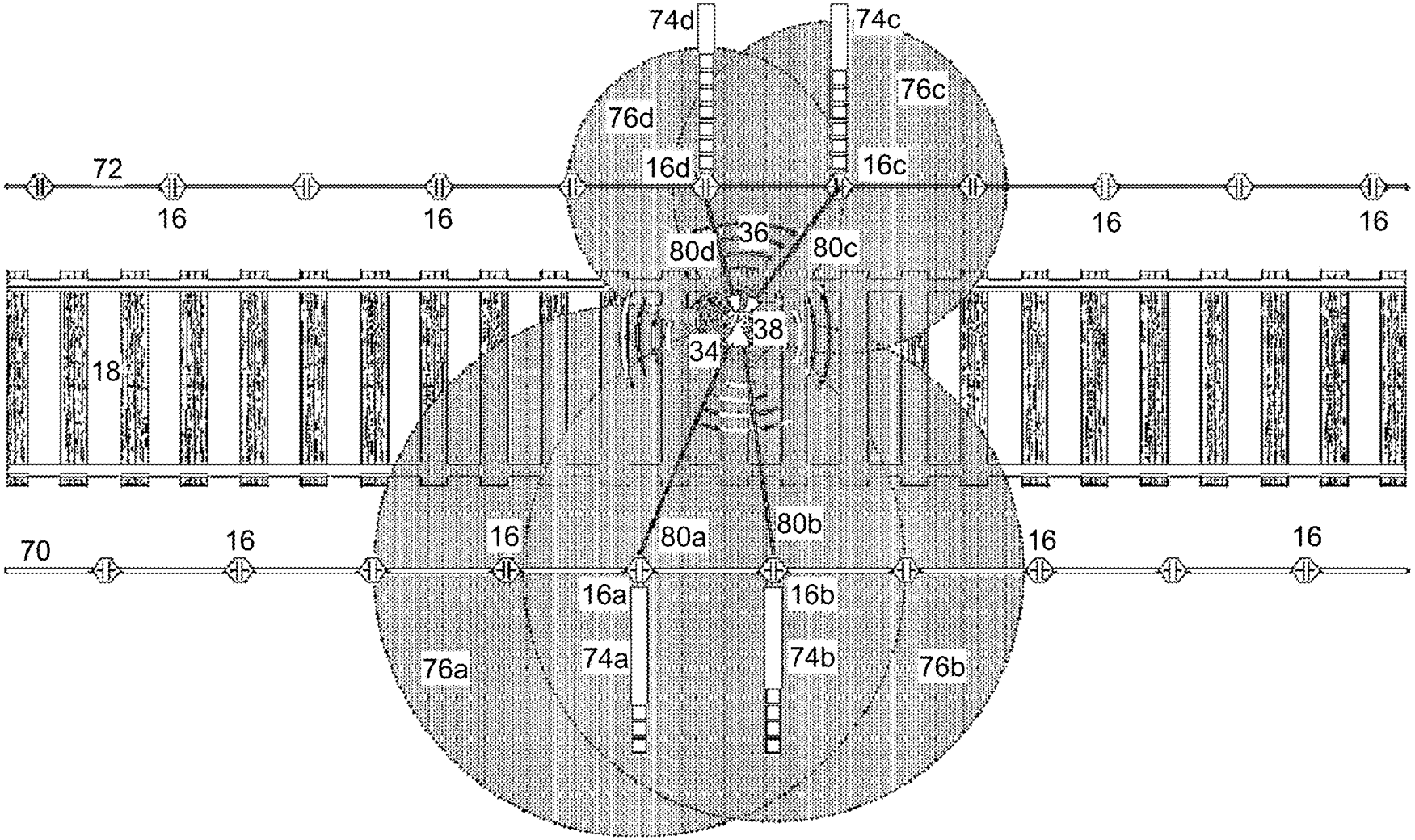
FIG. 2 is a plan view of the track and system components shown in FIG. 1 illustrating one method and system for locating an event using more than one optic fiber according to one aspect of the invention.

In an embodiment of the invention, the ability to locate and track events is enhanced by using at least two sensing arrays, positioned on opposite sides of the rail track 18 as illustrated in FIG. 2. The placement and number of the fibers 14 on opposite sides of the rail track 18 may be varied depending on the specific application.

FIG. 2 illustrates a large item, such as a boulder, 34 that has fallen onto the track 18, coming to rest towards one side of the track 18. In this illustration, the fall of the boulder 34 has generated acoustic vibrations 36 which can be detected by the various sensors 16, in FIG. 2 specifically sensors 16*a*, 16*b*, 16*c*, and 16*d*. Though any sensor 16 within the acoustic travel path of the acoustic vibrations 36 may detect acoustic vibrations 36, these sensors 16*a*, 16*b*, 16*c*, and 16*d* are used for illustrative purposes. As shown in FIG. 2, the These vibrations 36 are detected at various intensities 74*a* through 74*d*, which in the illustrative example of FIG. 2 are shown as various scale elevations. According to aspects of the invention, the intensities 74*a-d* of each acoustic vibrations 36 can be used to estimate a distance for the signal, which can be illustrated as the radii of circles 76*a-d* showing the entire range of possible locations for the acoustic vibrations 36 from the point of view of each of the sensors 16*a-d*. In one aspect, the intersection of the circles 76*a-d* identified by location 78 can define a set of corresponding location vectors 80*a-d*, which can indicate the position 78 of the fallen boulder 34. In general, assuming the sensors 16 are all of like performance, the more sensors 16 that provide data to determine the intersection point 78, the more accurately the target can be located.

Figure 3:
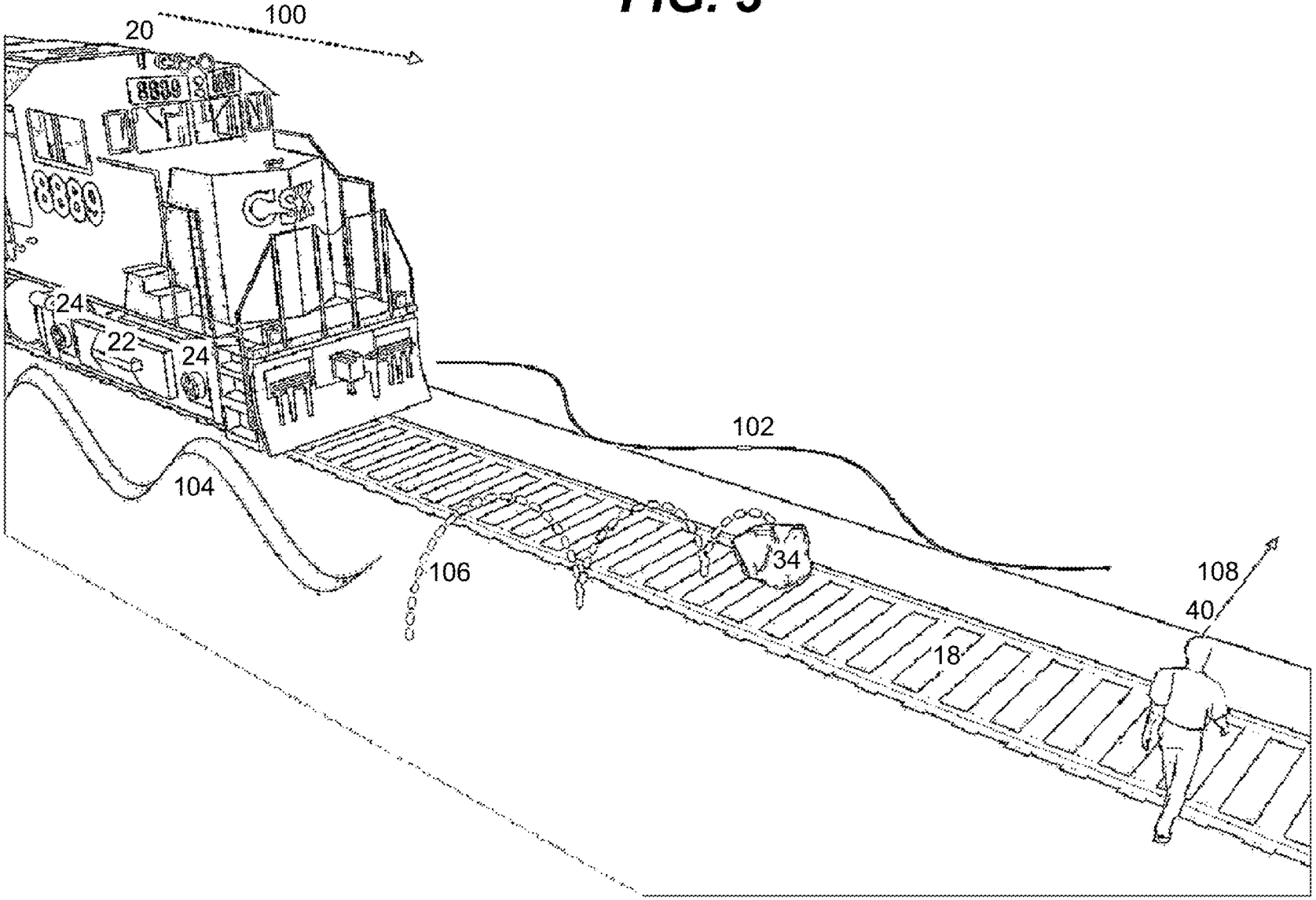
FIG. 3 is a perspective view of the train and track of FIG. 1 illustrating low frequency events in the field according to one aspect of the invention.

FIG. 3 illustrates a train track 18 with a train 20 moving in a direction of arrow 100 along the track 18. Also shown is a boulder 34, assumed to be rolling or have rolled onto the track 18, and a person 40 who is trespassing on the track 18. The train 20 travels on a number of trucks or bogies 22, each of which supports a number of wheels 24. A common issue with a train 20 is that the truck 22 typically oscillates from side to side as it travels. This condition is represented by the waveform 102 in FIG. 3, which indicates a possible oscillation path for the front truck 22. The frequency of the oscillation 102 depends on the speed, structure, and geometry involved. While wheels 24 may rotate many times during one cycle of an oscillating truck 22, and thus the oscillating frequency 102 may be much lower than that of the rotating wheels 24.

The rotating wheel frequency, illustrated by waveform 104 in FIG. 3, may allow for two common railroad issues to be detected via frequency 104: wheel flats and out-of-round wheels. Wheel flats can be distinguished from out-of-round wheels by their acceleration profile; a wheel flat produces a sharp, short impact acceleration profile, while out-of-round wheels present a smoother varying-acceleration profile. Both acceleration profiles may occur in synchronization with the wheel rotational frequency, as the wheel flat is at a particular point on the rotating wheel 24, and the out-of-roundness is a fixed geometric aspect of the rotating wheel 24.

Falling rocks 34 may roll or bounce to their positions on track 18, as shown by one example pathway 106. The rolling or impacts are also limited in speed and exhibit a lower frequency emission. The fall of a rock 34 onto the track 18, or near it, may also have a residual attribute from strain imparted to any sensors 16 by the addition of weight to the track 18 or nearby area.

The intrusion of human beings 40 or other animals is also detectable by the vibration signals based on speed and method of locomotion. A human being 40 walking in a straight line 108 may show their presence as a series of low-g impacts at frequencies matching the step rate of the human being 40.

The events or anomalies shown in FIGS. 2 and 3 are in not intended to be an exhaustive illustration or catalogue of either the issues facing a railroad or its rolling stock, or those which may be detected by the present invention.

As shown earlier in FIG. 2, the same methods used there to locate a fallen rock may also allow the proposed systems and methods to trace the movements of a human or animal.

Figure 4:
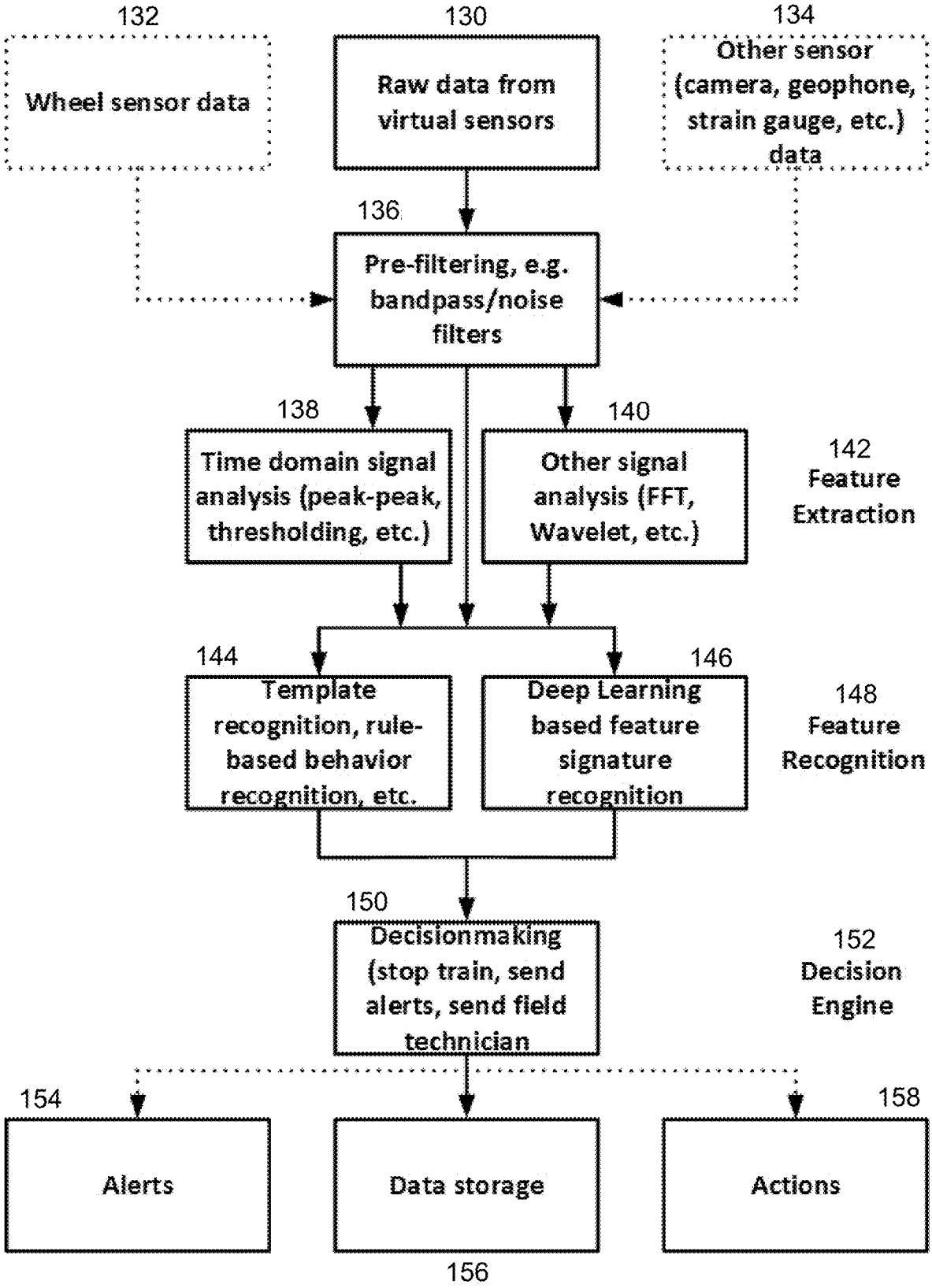
FIG. 4 is a flowchart illustrating an environment for a distributed optical acoustic sensing system according to one aspect of the invention.

FIG. 4 is a flowchart 120 that illustrates the basic process of one aspect of the present invention. As shown in FIG. 4, raw data from the sensors 130, for example, sensors 16 shown in FIGS. 1 and 2, are collected; in addition, wheel sensor data 132 or other sensor data 134 may also be collected. All sensor data 130, 132, and 134 may then be subjected to pre-filtering 136, such as bandpass and noise filters, to, for example, remove irrelevant signals and confounding noise from the raw data. Following the pre-filtering 136, the data 130, 132, and 134 may be passed to other processing steps.

Time-domain signal analysis 138 which may include measuring peak-to-peak variation, thresholding levels, change over time, Kalman filters, and other common signal analysis techniques 140, which may include Fast Fourier Transform (FFT) analysis, wavelet analysis, and others. Time-domain signal analysis 138 and/or signal analysis techniques 140 are the feature extraction 142 component of the invention.

Following feature extraction 142, the extracted feature data may be sent for analysis by various algorithmic or heuristic analysis methods 144, such as template recognition or rule-based behavior recognition, or to artificial intelligence/deep learning analysis 146, which may include learned feature signature detection, behavioral recognition and prediction, and other more complex analyses based on training a deep learning system on a wide variety of inputs. Together, algorithmic or heuristic analysis methods 144 and/or artificial intelligence/deep learning analysis 146 are the feature recognition subsystem 148 of an aspect the present invention.

Following feature recognition 148 analysis, the results are processed for decision-making 150, which may involve involves determining, based on what events or features have been recognized, what the appropriate response of the system should be. This overall operation is called the decision engine 152 of the system of an aspect the present invention.

Once a decision is reached, some form of response may be made. This response may range from sending an alert 154 to a train or remote location, to simply storing the data 156 for reference if no real threat is seen, to taking direct action 158, such as stopping a train, if the situation warrants it.

Another consideration with respect to one aspect of the invention is the physical division of the operations or steps described in FIG. 4. While it would be possible to have all processing performed at the central data storage and processing facility 46, as seen in FIG. 1, this would require the entirety of the data collected by all relevant interrogators 10 to be sent to the processing facility 46. In one aspect, many, if not all, of the operations can be performed at the interrogator 10, see FIG. 1, using processing capabilities integrated at the interrogator 10.

The interrogator 10, therefore, could perform the pre-filtering 136, amplification, and other processes 142, 148, and/or 152 for all of the sensors 16, and pass that data on to the other portions of the software.

An embodiment of the invention includes the use of a plurality of fibers 14. One aspect of the invention may uses a single fiber 14 to detect the events of interest. In FIG. 2, it is shown that additional fibers can provide more data for appropriately tracking and localizing events. In this alternative embodiment of the invention, two or more fibers 14 may be used, the different fibers 14 may be separated by some distance in order to differentiate between locations and events, and to provide redundancy and robustness of operation. Appropriate multiplexing permits this redundancy to be exploited in a manner that provides greater reliability of the entire system. Additionally, if there are multiple tracks 18, using multiple fibers 14 may assist-in determining what events and conditions are associated with which tracks 18.

Figure 5:
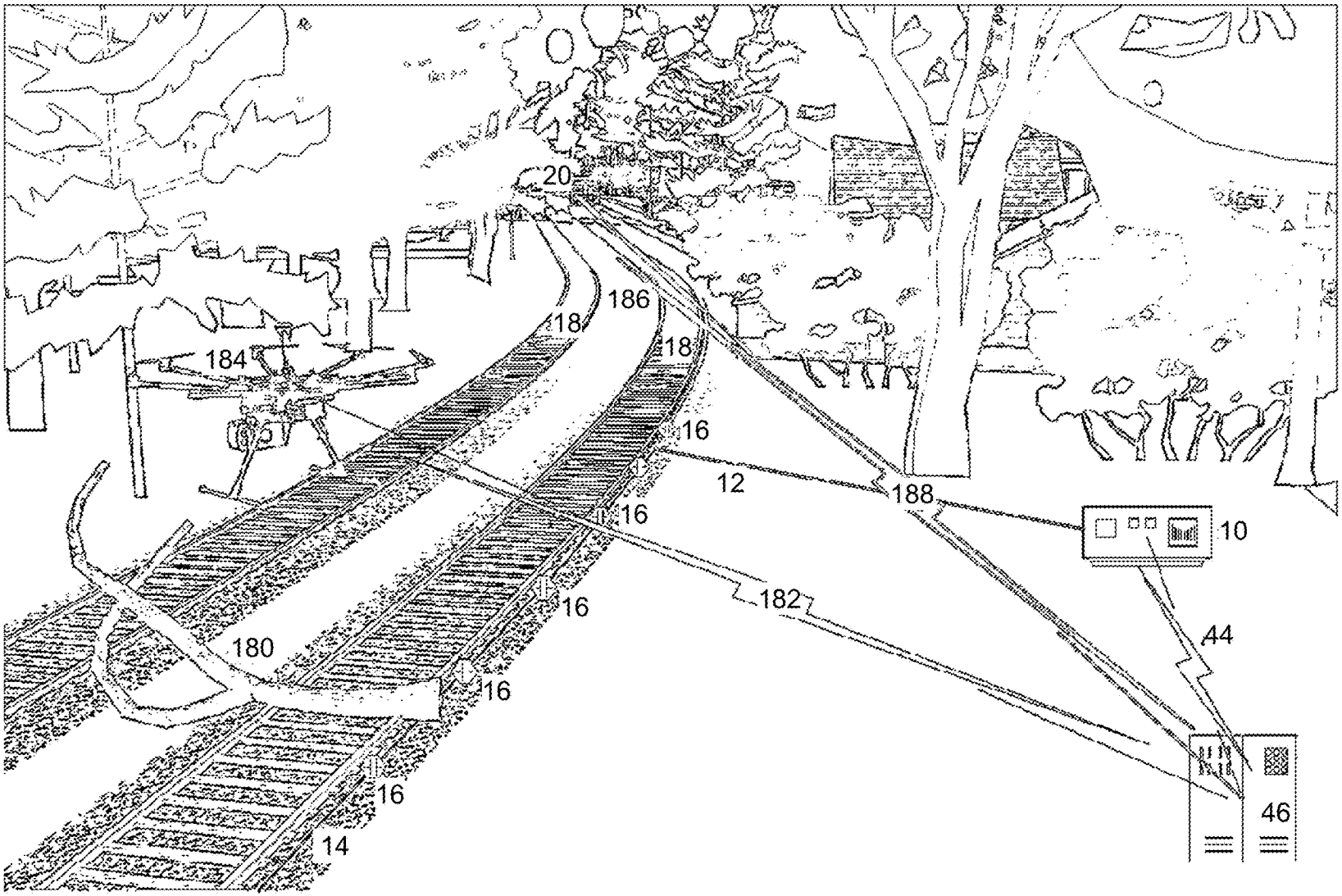
FIG. 5 is a perspective view illustrating a method and system for event detection using wired or wireless transfer of information according to one aspect of the invention.

An embodiment of the invention includes the use of a system with at least one mobile component such as an unmanned ground or air vehicle. In this embodiment, the system may detect such an event, and then may dispatch an autonomous vehicle to the location to gather additional information, which may be wirelessly relayed to the system for additional analysis and decision making. FIG. 5 illustrates this concept. As shown in FIG. 5, a train 20 is traveling down a track 18 onto which a log 180 has fallen. An interrogator 10 is connected 12 to a fiber 14, which provides sensors 16. The data from the virtual sensors 16 is sent via a wired or wireless connection 44 to a central system 46 for analysis. The analysis reveals that an object 180 has fallen onto the tracks 18, but the type and location of the object 180 are not defined. Because of this, the central system 46 establishes a control connection 182 with an inspection drone 184, and directs the inspection drone 184 to the area of the object (the log 180). Data from the drone 184 is transmitted to the central system 46 through the connection 182. It should be noted that the system 46 could also signal a human operator to start, direct, and control the drone 184. The train 20 cannot see the log 180 because the log is around a curve 186 and there is not a clear line of sight from the train 20 to the log 180, especially if the train 20 is not very close to the log 180. If the system 46 concludes that there is a threat to the train 20, the train 20 is notified through a wireless connection 188. It should be noted that the notification or warning could also be sent via wired or wireless connection to human agents who could then determine whether action was warranted.

Figure 6:
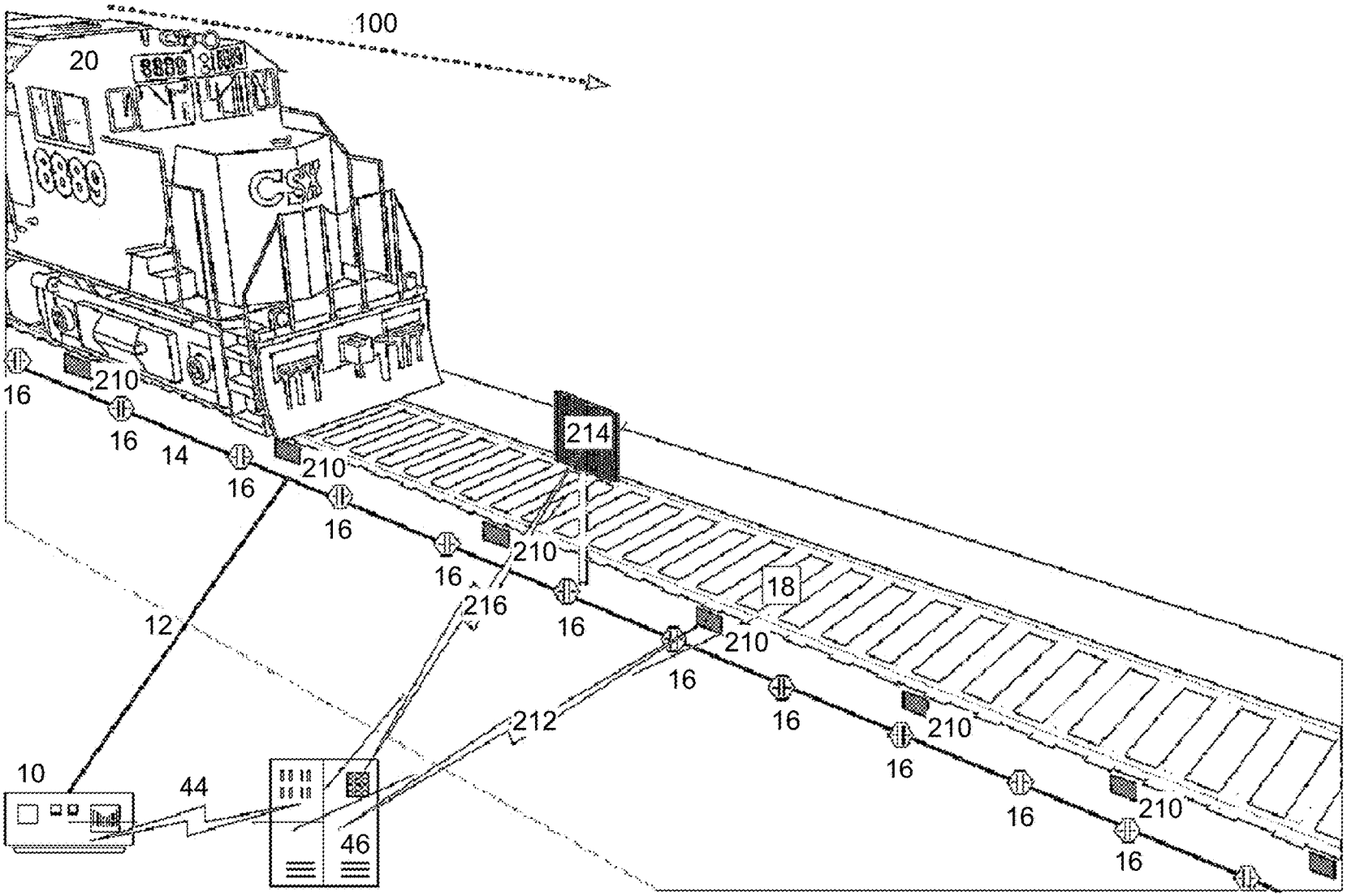
FIG. 6 is a perspective view, similar to FIG. 3, illustrating a method and system for using event detection to enable system according to one aspect of the invention.

An embodiment of the invention includes the use of a system with integrated wheel sensors. Wheel sensors positioned along the track 18 can provide real time train speed, which allows the frequency from the detected vibrations to be determined for any potential flat spots to be monitored. Incorporating wheel sensors permits the system to reduce power of operations when no train is operating in the area. The wheel sensors may provide a "wakeup" method as well as additional data for processing. FIG. 6 illustrates this embodiment. As shown in FIG. 6, as with other embodiments, at least one fiber 14 operatively connected to sensors 16 is connected 12 to an interrogator 10; data from the sensors 16 is transmitted through the connection 12 and through a wired or wireless connection 44 to a central processing and storage system 46. This fiber 14 may be position substantially parallel to a set of railroad tracks 18, along which a train 20 travels at speed and direction indicated by arrow 100. In addition, wheel sensors 210 are placed at intervals along the track 18. In the preferred aspect of the invention, the wheel sensors 210 are wireless and self-powered and able to be practically spaced along the entirety of the track 18, although wired wheel sensors may be applicable in some aspects of the invention. In any event, the wheel sensors 210 are able to convey their data through some channel 212; this may be a direct wireless connection to the central system 46, or gathered by some form of aggregators spaced at some distance along the track 18. The wheel sensors 210 may be able to inherently measure the speed and direction 100 of the train 20, or the speed and direction 100 may have to be calculated from the interval of passage for each wheel 24 between one wheel sensor 210 and another. In the latter case, the wheel sensors 210 may be spaced closely enough that it is feasible to calculate a reasonably accurate speed and direction 100 from the data. In one aspect of the invention, the system may also include an identification tag reader 214, also connected by some means 216 to the central system 46. Many trains, especially freight trains, have ID tags for each car that include considerable information, including nominal wheel sizes. Knowing the speed of the train and the wheel size allows an easy calculation of the interval for one revolution of the wheels. This, in turn, provides the exact frequency expected for an out-of-round or wheel flat, allowing these to be discriminated from, for example, wheel flanging/hunting. In addition, being able to specifically identify train cars would also permit this embodiment to link any flaws detected on a passing train to the exact car with the flaw.

This embodiment and FIG. 6 is not limited to wheel sensors alone. Wheel sensors 210 could also be, or could incorporate, other sensors. For example, geophones could be spaced along the track in the same manner as wheel sensors 210, to detect the particular signatures of wheel flats, assisting in disambiguating them from other train or track issues. Similarly, other sensors could be substituted for or added to the wheel sensors 210, such as strain gauges, weather sensors for predicting events such as washouts or landslides, temperature sensors, and other sensors as applicable.

An embodiment of the invention includes the use of phase difference measurement. The ranging approach shown in FIG. 2 may be adequate for some applications, but adding the measurement of phase differences (essentially, differences in the time of arrival of signals from the same event) allow the system to perform measurements of location, behavior, and size to a much greater degree of accuracy and reliability.

Figure 7A:
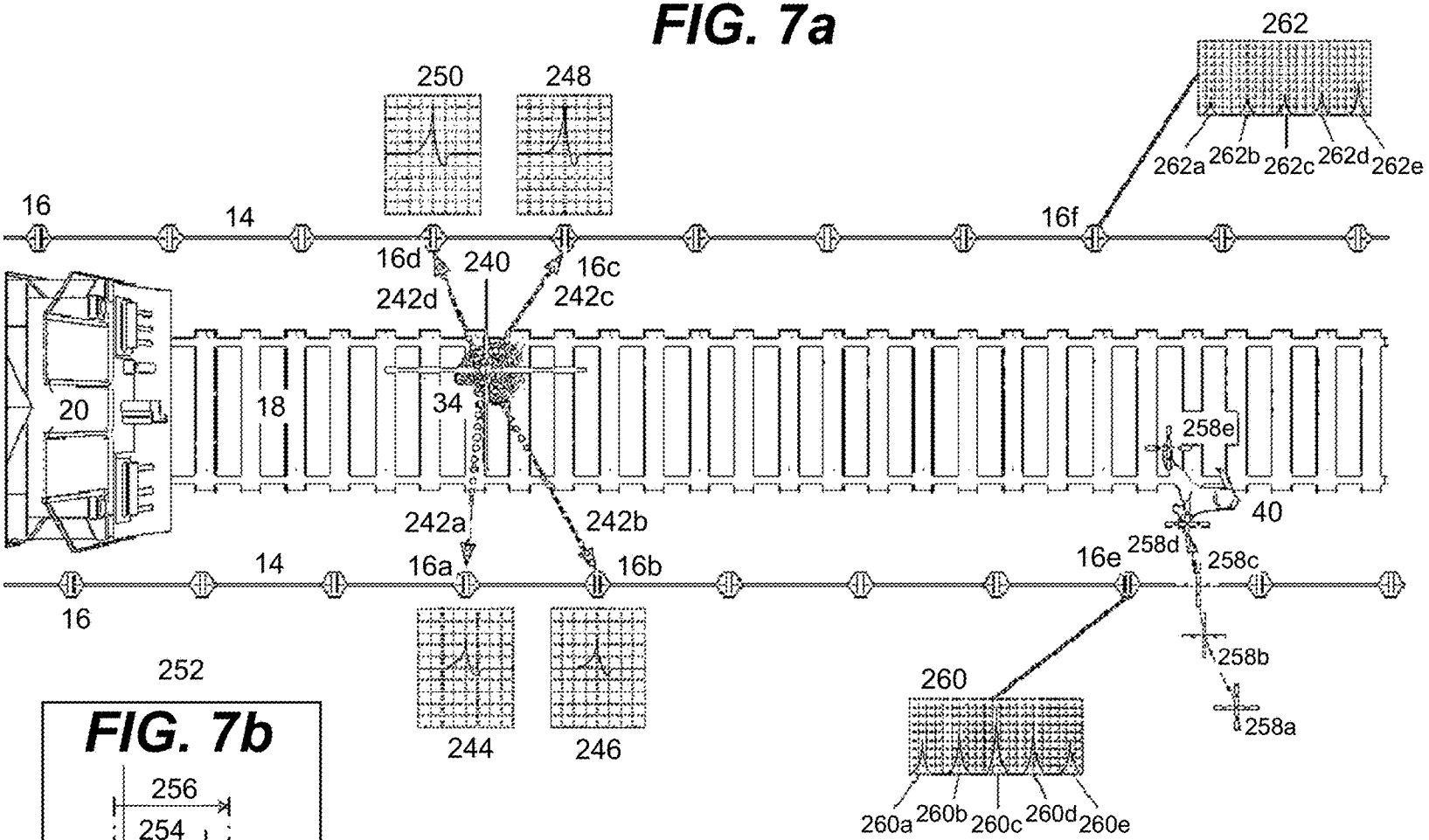
FIG. 7*a* is a plan view, similar to FIG. 2, illustrating a method and system of using signal analysis to determine event attributes according to one aspect of the invention.

FIG. 7 illustrates this. In FIG. 7*a*, a pair of fibers 14 provided with virtual sensors 16 run on either side of a train track 18, along which a train 20 may proceed. Events of interest may include the falling of a rock 34 onto the tracks 18, or a person 40 or other animal or vehicle entering the area on and around the tracks 18.

Figure 7B:
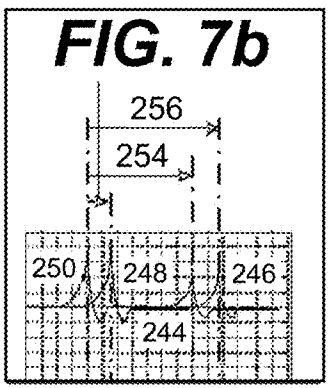
FIG. 7*b* is a detail of a typical signal comparison according to the aspect of the invention shown in FIG. 7*a*.

When the rock 34 falls onto the tracks at a specific location 240, rock 34 may produce acoustic vibrations that are picked up by specific sensors 16*a-d*. These vibrations must travel various distances 242*a-d* respectively to the corresponding sensors 16*a-d*. Because the distances 242 vary, both the time for the actual acoustic vibration to arrive, and its amplitude, vary, producing individual waveforms 244, 246, 248, and 250, respectively. In the case presented, the rock 34 is closest to virtual sensor 16*d*, meaning that waveform 250 is the first produced, with the others arriving later. This is illustrated in FIG. 7*b*; the signals 250 and 248 are separated by a short time interval 252, with 244 coming after a longer interval 254 and 246 arriving after the longest interval 256.

These signals all originate from the same event, the boulder 34 falling onto the tracks 18, their separations in time are purely due to the distance of each of the sensors

16*a-d* from the landing point 240 of the rock 34. As the speed of transmission of sound through the environment can be known, these differences in time can be converted to distances. Since the distances of the sensors from each other can be determined directly from the system's measurements, this allows an accurate pinpointing of the location 240 of the rock 34.

Applying these techniques and those previously described to sequences of events allows for tracking, behavior analysis, and size estimation. As also shown in FIG. 7*a*, a man 40 is walking across the tracks 18, and the system can follow his path through individual footsteps 258*a-e*. Sensors 16*e* and 16*f* each record the sequence of steps, signals shown in 260 and 262, respectively. The individual footsteps show in these sequences as the peaks 260*a-e* and 262*a-e*, respectively, in the insets in FIG. 7A. Applying the previous techniques of distance and location analysis allows the data from sensors 16*e* and 16*f* to determine the location of each footstep 256*a-e* and thus the path taken by the person 40.

The discussed technique of distance and location measurement relies on matching the peaks and measuring the phase difference between one peak in the sequence and the corresponding peak in the other sequence. In some cases, it may be challenging to prevent aliasing, cases in which the interval between the arrivals of a given signal may overlap with the arrival of an earlier but nearer signal. There are a number of methods to disambiguate this; one, which also lends itself to estimating the size, is to compare the amplitudes of the signals, both between sequences (260 compared to 262) and within sequences (260*a* compared with b, c, d, e). For example, in sequence 260, we see that the amplitudes of 260*a-e* follow a pattern of increase from a-b, then from b-c, then a decrease from c-d, and another from d-e. Taken together, and with the assumption that the target is not changing in overall size or method of generating vibrations/impacts, we conclude that the person 40 was coming closer to sensor 16*e*, reached a closest approach (crossing the fiber 14) at the point 258*c* represented by peak 260*c*, and continued on. By contrast, the amplitudes seen in 262 increases reasonably steadily, showing that the person 40 is walking towards the fiber 14 on the side where 16*f* is located.

An aspect of the invention includes the use as derailment detection. When a car derails, it will cause damage to the infrastructure of the rail line (ties, etc.) and likely to itself, and may cause the entire train to derail with catastrophic results. The present invention can be used to detect such derailments, as illustrated in FIG. 8.

Figure 8:
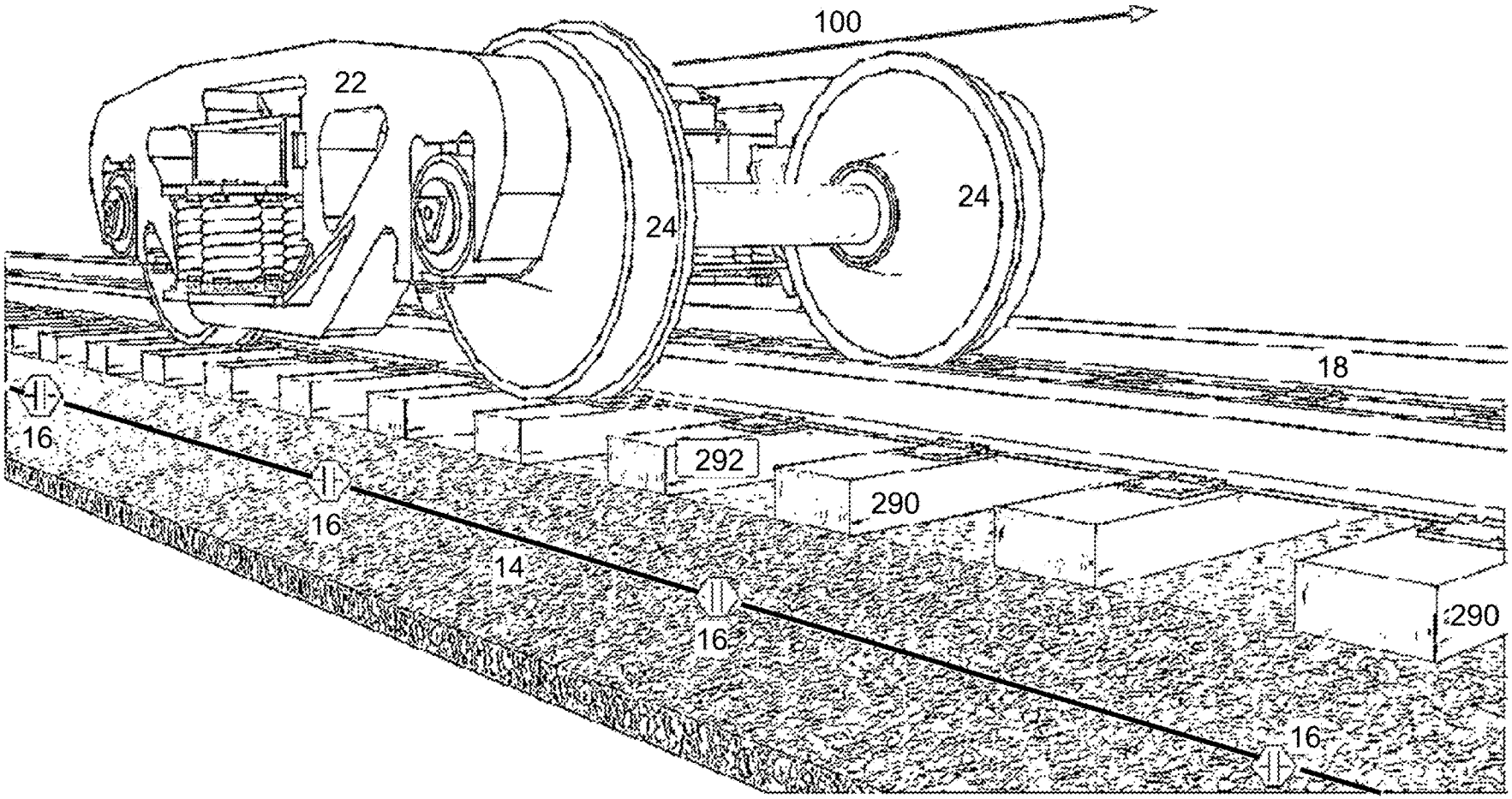
FIG. 8 is a perspective view illustrating an environment for monitoring rail operations according to one aspect of the invention.

In FIG. 8, a bogey 22, with the remainder of the train car eliminated for clarity, travels down rails 18 in a direction indicated by arrow 100. However, this bogey 22 has been derailed, such that the wheels 24 now roll on the supporting ground and the ties 290. A fiber-optic cable 14, as discussed previously, provides various sensors 16 which can detect vibrations. The derailed wheels 24 impact with the ties 290, producing detectable vibrations 292.

These vibrations, like those produced by flat spots, will be repeating and related to the speed of the train. However, unlike flat spots or other defects of wheels, the repetition rate will not match that of a single wheel rotation, but rather the interval between ties. Using this timing information, and difference in the vibrational signature, the invention can therefore detect derailments. Even if the derailed wheels 24 can no longer be detected by previously described wheel sensors 210, the wheels of the other cars of the train which remain properly on the rails will be; all cars of the train, being physically connected, must travel at the same speed, and thus the speed from the nearest active wheel sensor may be used for this purpose. Other methods of measuring the speed of the train may also be used.

An aspect of the invention includes the use of the system with cameras and other sensors. If an event occurs, analyzing video of the location could provide invaluable information. The system could have, as one of the actions 158 options (see FIG. 4), to activate a camera and then analyze the data as shown in FIG. 4. Other options could be explored with other sensors for both immediate and long-term analysis, such as for example, various weather sensor data could be gathered and correlated with events of interest.

An aspect of the invention includes the use of the system for security monitoring. It is not necessary for the described system to be used exclusively for railroad monitoring. In another embodiment, existing or new fiber optic fibers may be installed around and through a location— a military base, a manufacturing area, etc.—and monitored specifically to detect intrusion by persons and vehicles, tracking them, gauging their activity, and performing alerts and actions as appropriate. In one aspect, road monitoring may be practiced by using either an existing dark fiber or custom installed fiber, a network of interrogators may be installed to monitor total traffic including speed, and direction. The aspects of the invention provide for determining individual vehicle speeds. Additionally, aspects of the invention may provide a system adapted to detect intrusion on the road, monitor asset condition, and/or provide automatic incident alerts.

An aspect of the invention includes the use for mine operation monitoring. Mining operations are often constant, dangerous, and noisy, with many challenges in properly monitoring the operations and events happening. The presented invention may be embodied in several ways to assist in this type of operation: This may include operational, environmental, critical asset, and safety situational awareness advantages.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A system for monitoring a transportation path, the system comprising:

first fiber optic fiber extending along at least a portion of a targeted transportation path;

a second fiber optic fiber extending along at least the portion of the targeted transportation path, wherein the second fiber optic fiber is spaced from the first fiber optic fiber by a known distance, each fiber optic fiber having a plurality of imperfections;

an interrogator operatively connected to the first and second fiber optic fibers, the interrogator configured to detect reflections from the plurality of imperfections in each fiber optic fiber;

a processor operatively connected to the interrogator, wherein the processor is configured to:

receive signals from the interrogator corresponding to the detected reflections;

associate variations in the received signals with signals generated by an anomaly along the transportation path;

determine a location of the anomaly by measuring phase differences corresponding to the variations in the received signals detected on both the first and second fiber optic fibers; and depending upon the anomaly, execute one of a plurality of protocols.

2. The system as recited in claim 1, wherein the signals generated by the anomaly comprise at least one of an acoustic signal or a vibration signal.

3. The system as recited in claim 1, wherein the first fiber optic fiber is positioned on a first side of the transportation path and the second fiber optic fiber is positioned on a second side of the transportation path, opposite the first side of the transportation path, and wherein the processor is further configured to determine whether the location of the anomaly is within or outside of the targeted transportation path.

4. The system as recited in claim 1, wherein the processor is located within the interrogator.

5. The system as recited in claim 1, wherein the processor is located remote of the interrogator.

6. The system as recited in claim 1, wherein the variations in the received signals correspond to a wheel or a tire anomaly.

7. The system as recited in claim 1, wherein the variations in the received signals correspond to an obstruction of the transportation path.

8. The system as recited in claim 1, wherein the system further comprises an inspection vehicle, wherein the one of the plurality of protocols includes dispatching the inspection vehicle to the location of the anomaly along the transportation path.

9. The system as recited in claim 1, wherein the system further comprises a plurality of wheel or tire sensors, and wherein the processor is further configured to determine a speed of a vehicle traveling on the transportation path using sensor data acquired from the plurality of wheel or tire sensors.

10. The system as recited in claim 1, wherein the system further comprises a vehicle ID sensor, and wherein the processor is further configured to determine a nominal wheel size of a vehicle traveling on the transportation path using sensor data acquired from the vehicle ID sensor.

11. A method for monitoring a transportation path, the method comprising:

detecting reflections from a plurality of imperfections in a first and fiber optic fiber extending along at least a portion of a targeted transportation path, and a second fiber optic fiber extending along at least the portion of the targeted transportation path, wherein the second fiber optic fiber is spaced from the first fiber optic fiber by a known distance;

generating electrical signals corresponding to the detected reflections;

analyzing the generated electrical signals to extract at least one feature of the generated signals;

comparing the at least one feature to a plurality of features and recognizing the at least one feature as a signal generated by one of a plurality of anomalies;

determining a location of the anomaly by measuring phase differences corresponding to the variations in the received signals detected on both the first and second fiber optic fibers; and based upon the one of the plurality of anomalies, executing at least one protocol.

12. The method as recited in claim 11, wherein the signals generated by the anomaly comprise at least one of an acoustic signal or a vibration signal.

13. The method as recited in claim 11, wherein comparing and recognizing comprises at least one of template recognition, rule based behavior recognition, or deep learning based feature signature recognition.

14. The method as recited in claim 11, wherein the plurality of anomalies comprises at least one of an anomaly in vehicle operation, a crash or a derailment, hardware damage, an obstruction on the transportation path, a pedestrian trespassing, or an animal intrusion.

15. The method as recited in claim 11, wherein the at least one protocol comprises dispatching a vehicle to the location of the anomaly.

16. The method as recited in claim 11, wherein analyzing the generated electrical signals to extract at least one feature of the generated signals comprises vehicle crash or derailment analysis.

17. The method as recited in claim 11, further comprising determining whether the location of the anomaly is within or outside of the targeted transportation path.

18. A system for monitoring a railroad track, the system comprising:

a first fiber optic fiber extending along at least a portion of the railroad track;

a second fiber optic fiber extending along at least the portion of the railroad track, wherein the second fiber optic fiber is spaced from the first fiber optic fiber by a known distance, each fiber optic fiber having a plurality of imperfections;

a plurality of receiving units operatively connected to the first and second fiber optic fibers, wherein each of the plurality of receiving units is configured to detect reflections from at least a portion of the plurality of imperfections in each fiber optic fiber;

a computer system including at least one processor, wherein the computer system is operatively connected to the plurality of receiving units, and wherein the computer system is configured to:

receive signals from the plurality of receiving units corresponding to the detected reflections;

associate variations in the received signals with signals generated by an anomaly along the railroad track;

determine a location of the anomaly by measuring phase differences corresponding to the variations in the received signals detected on both the first and second fiber optic fibers by at least one of the plurality of receiving units; and depending upon the anomaly, execute one of a plurality of protocols.

19. The system of claim 18, wherein the one of the plurality of protocols includes dispatching a vehicle to the location of the anomaly.

20. The system of claim 18, wherein the one of the plurality of protocols includes communicating data regarding the anomaly to a train traveling along the railroad track.

* * * * *